United States Patent [19]

Ragaller

[11] 4,371,765

[45] Feb. 1, 1983

[54] ELECTRICAL SWITCH FOR LARGE CURRENTS

[75] Inventor: Klaus Ragaller, Neuenhof, Switzerland

[73] Assignee: BBC Brown, Boveri & Company, Ltd., Baden, Switzerland

[21] Appl. No.: 151,874

[22] Filed: May 21, 1980

[30] Foreign Application Priority Data

May 25, 1979 [CH] Switzerland ..... 4877/79

[51] Int. Cl.[3] ..... H01N 33/18

[52] U.S. Cl. ..... 200/147 R; 200/148 A; 200/146 R; 200/148 C

[58] Field of Search ..... 200/148 R, 148 A, 147 R, 200/149 B, 146 R

[56] References Cited

U.S. PATENT DOCUMENTS

| | | | |
|---|---|---|---|
| 3,906,180 | 9/1975 | Glarner | 200/148 R |
| 4,046,978 | 9/1977 | Badon | 200/148 A |
| 4,221,942 | 9/1980 | Hertz et al. | 200/147 R |

FOREIGN PATENT DOCUMENTS

| | | | |
|---|---|---|---|
| 2813084 | 10/1979 | Fed. Rep. of Germany | 200/148 A |

*Primary Examiner*—Robert S. Macon

*Attorney, Agent, or Firm*—Burns, Doane, Swecker & Mathis

[57] ABSTRACT

An electrical switch for large currents is disclosed in which an electric arc generated during separation of contact members is exposed to blow-out by a magnetic field generated by current flow in a looped-region of one of the contact members. The switch includes at least two rotationally symmetric contact pieces, at least one of which has a plurality of contact elements arranged in an annular configuration in the circumferential direction. The contact elements include a looped-region which generates the magnetic field to which the electric arc is exposed. The contact elements may consist of a plurality of contact fingers accommodated by a contact piece, or may consist of a plurality of contact bars integrally formed with a contact piece. The contact elements, which extend substantially in the make/break direction of the switch, may be spring loaded or may be supported in a spring-loaded fashion.

7 Claims, 3 Drawing Figures

ELECTRICAL SWITCH FOR LARGE CURRENTS

BACKGROUND OF THE INVENTION

This invention relates generally to electrical switches, and more particularly to an electrical switch for large currents.

In conventional high voltage switches for large currents, the rated current is conducted through several contact elements connected in parallel in order to obtain the lowest possible contact resistance. During the opening operation of the switch as the switch moves in a make/break direction from a make-position in which a circuit is electrically closed to a break-position in which the circuit is electrically open, the current is commuted from a rated making current path to a power path. The inductance of the power path may create problems in commutating very large currents.

An electrical switch for large starting currents is disclosed in Federal Republic of Germany Patent No. 11 91 465. The switch disclosed therein includes a contact piece made from an elastic tube. A plurality of slits are inflicted on the tube in order to form a plurality of contact bars. The contact bars cooperate with a solid contact piece in the make-position of the switch in order to close the electrical circuit. The elasticity of the tube makes the contact bars self-loading, and urges the contact bars against the solid contact piece. Additional springs are also used to further urge the contact bars toward the solid contact piece.

The contact bars are essentially straight contact elements, and thus represent practically the shortest current path between the slit, elastic tube contact piece and the solid contact piece. However, during the closing operation of the switch as the switch is selectively operated from the break-position to the make-position the contact elements do not remain in physical contact with the solid contact piece once physical contact is made, but rather the contact elements bounce back and forth. This undesired contact bounce results in harmful burning of the contacts. The additional springs are provided in order to reduce the contact bounce and thereby reduce the burning. However, such an expedient deals only with problems arising during the closing operation of the switch, but not during the opening operation.

It is therefore an object of the present invention to improve the commutation of current from the rated making current path to the power path with a relatively uncomplicated switch structure.

SUMMARY OF THE INVENTION

According to a preferred embodiment of the present invention, an electrical switch for large currents includes at least two rotationally symmetric contact pieces. At least one of the contact pieces has a plurality of contact elements arranged in an annular configuration in the circumferential direction of the contact piece. Preferably, the contact elements are spring loaded and are urged in the radial direction by a spring element. The contact elements may also be supported in a spring-loaded fashion without the use of spring elements. Preferably, the contact elements are disposed such that they extend substantially in the make/break direction of the switch.

The contact elements include means for exposing the electric arc generated during the electrical disconnection of the contact pieces to the blow-out effect of a magnetic field, thereby promoting extinction of the arc.

Preferably, each contact element includes a looped-region, and the magnetic field is generated by current flow through the looped-region of the contact element.

According to one preferred embodiment of the present invention, the contact elements comprise a plurality of contact fingers. Each of the contact fingers can be individually replaced. Therefore, all the contact fingers need not be replaced when a lesser amount become damaged.

According to another preferred embodiment of the present invention, the contact elements comprise a plurality of contact bars. The contact bars are preferably formed by inflicting a plurality of slits on a metal tube which comprises a contact piece of the switch, the slits extending longitudinally from an end of the metal tube. In this embodiment, the inherent elasticity of the metal tube urges the contact bars in a radial direction toward another contact piece. Spring elements may be used to further urge the contact bars in the radial direction.

According to another embodiment of the present invention, an electrical switch includes three contact pieces arranged in such a manner with respect to each other that when the switch is selectively operated a two-stage commutation occurs.

BRIEF DESCRIPTION OF THE DRAWINGS

The preferred embodiments of the present invention are described with reference to the accompanying drawings wherein like members bear like reference numerals, and wherein.

DESCRIPTION OF THE PREFERRED EMBODIMENTS

Figure 1:
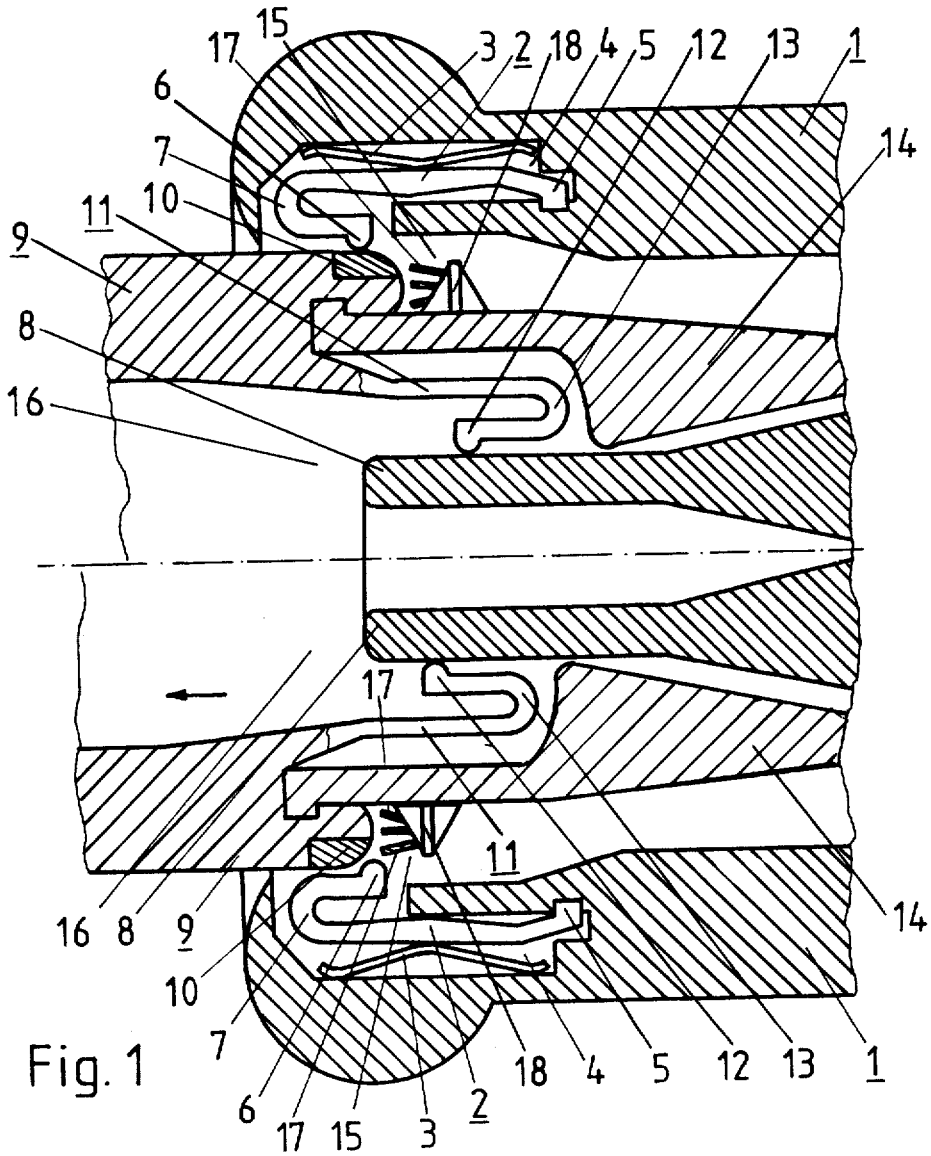
FIG. 1 is a cross-sectional view of an electrical switch according to the present invention.

Referring to FIG. 1, an electrical switch includes an external stationary contact piece 1, an internal stationary contact piece 8, and a mobile contact piece 9. The external stationary contact piece 1 is a rotationally symmetric contoured tube having an annular recess 4. A plurality of contact fingers 2 are accommodated in the annular recess 4 of the contact piece 1. The contact finger 2 is urged radially inward by a flat spring 3 also accommodated in the annular recess.

The contact finger 2 includes an end 5 which mechanically and electrically connects the contact finger to the contact piece 1. The contact finger 2 also includes a contact end 6 which is illustrated in the top half of FIG. 1 in electrical and mechanical connection with a contact ring 10 included on the mobile contact piece 9. The contact finger 2 has a looped-region 7 included between the end 5 and the contact end 6.

The internal stationary contact piece 8 is coaxially arranged inside the external stationary contact piece 1. The mobile contact piece 9 is arranged coaxially between the external stationary contact piece 1 and the internal stationary contact piece 8. The mobile contact piece 9 serves as the countercontact for the external stationary contact piece 1, and for the internal stationary contact piece 8.

The contact ring 10 included on the mobile contact piece 9 is disposed circumferentially about the contact piece 9 and opposite the contact fingers 2. The mobile contact piece 9 also includes contact bars 11 which have as their countercontact the internal stationary contact piece 8.

The contact bars 11 are formed by inflicting a plurality of substantially longitudinal slits into contact piece 9. The regions between the slits in the circumferential direction form the contact bars 11. Thus, the contact piece 9 and the contact bars 11 are of a one-piece construction.

The contact bar 11 includes a contact end 12 which is illustrated in the upper half of FIG. 1 in mechanical and electrical connection with the internal stationary contact piece 8. The contact bar 11 includes a looped-region 13 included between the contact end 12 and the unslit portion of mobile contact piece 9. A centering body 14 is inserted in the mobile contact piece 9.

An arc space 15 is included near the contact fingers 2, and an arc space 16 is included near the contact bars 11. Annular quenching sheets 17 are arranged in the arc space 15. The sheets 17 are supported by six star support elements 18 which are made of an insulating material.

The upper half of FIG. 1 illustrates the switch in the make-position in which the circuit is closed. In this position, current flows from the mobile contact piece 9 through the contact ring 10 included thereon, through the contact end 6 of the contact finger 2, through the looped-region 7 of the contact finger 2, and through the supported end 5 of the contact finger 2 to the external stationary contact piece 1.

As the switch is selectively operated from the make-position in which the circuit is closed, to the break-position in which the circuit is open, a medial position is reached as illustrated in the lower half of FIG. 1. In the medial position, the contact end 12 of the contact bar 11 is still in physical contact with the internal stationary contact piece 8. However, the contact end 6 of the contact finger 2 is no longer in physical contact with the contact ring 10 of the mobile contact piece 9. As the medial position is reached, an electric arc is generated between the contact ring 10 of the contact piece 9 and the contact end 6 of the contact finger 2. The arc is exposed to the blow-out effect of a magnetic field generated by current flow through the looped-region 7 of the contact finger 2. Exposed to the magnetic field, the arc is rapidly quenched because an alternate current path exists from the mobile contact piece 9 through the contact bars 11 to the stationary contact piece 8.

The velocity of the switching process increases with the voltage of the arc. The current path through the contact bars 11 with looped-regions 13 represent an inductive impedance which causes a delay in the flow of current through the contact bars 11. It is therefore advantageous to increase the voltage of the arc between the contact ring 10 of the mobile contact piece 9 and the contact end 6 of the contact finger 2. The extension of the arc caused by the magnetic field in the looped-region 7 of the contact finger 2 results in an increase in the voltage of the arc.

Figure 2:
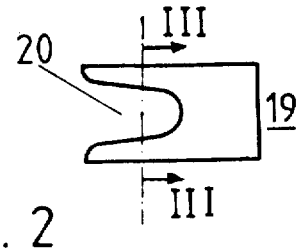
FIG. 2 is a planar view of a quenching plate included in a switch according to one embodiment of the present invention.
Figure 3:
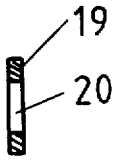
FIG. 3 is a cross-sectional view through the line III—III of FIG. 2.

The electric arc generated in the arc space 15 of the contact fingers 2 is cooled by the arc quenching system formed by the annular quenching sheets 17 illustrated in FIG. 1. Alternately, stirrup-shaped quenching plates may be used. FIG. 2 illustrates a stirrup-shaped quenching plate 19 having a recess 20. FIG. 3 is a cross-sectional view of the quenching plate 19 through the line III—III of FIG. 2.

Referring to FIG. 1, as the mobile contact piece 9 moves further in the direction of the arrow from the medial position illustrated in the lower half of FIG. 1 to the break-position in which the circuit is open, the contact ends 12 of the contact bars 11 separate from the surface of the internal stationary contact piece 8. Even though contact burning is more acceptable in this area of the switch, the arc drawn between the contact ends 12 and the internal stationary contact piece 8 are exposed to the magnetic field formed by current flow in the looped-regions 13 of the contact bars 11. A quenching system (not illustrated) may be included in the arc space 16 of the contact bars 11 in order to cool the arc. The quenching system included in the arc space 16 may include an annular quenching sheet or stirrup-shaped quenching plates.

In order to facilitate understanding the present invention, certain parts of the present invention have been illustrated and described as being single pieces. However, it is to be understood, that in an actual switch structure certain parts may be made as a combination of several parts for reasons of lay out or manufacturing technology.

It is to be further understood that switches with single-stage commutation may be used, and that known quenching systems other than quenching plates or quenching sheets may be used.

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Moreover, variations and changes may be made by those skilled in the art without departing from the spirit of the present invention.

What is claimed is:

1. An electrical switch particularly adapted for conducting and breaking large currents, comprising:

a first rotationally symmetric contact piece having an annular recess therein;

a first plurality of contact elements disposed within said annular recess and extending in the axial direction of said first contact piece, each of said contact elements including one end in mechanical and electrical connection with said first contact piece, a contact surface at the other end thereof, and a loop-shaped region between said two ends;

a spring element respectively associated with each of said contact elements for urging said contact element in a radial direction;

a second rotationally symmetric contact piece that is selectively movable relative to said first contact piece from a first position, in which said second contact piece is in mechanical and electrical contact with the contact surface at said other end of said contact elements, to a second position in which said second contact piece is disconnected from said contact elements, whereby an electric arc that is generated during such movement is exposed to the blow-out effect of a magnetic field generated by the flow of current in said loop-shaped regions in said contact elements;

a third rotationally symmetric contact piece that is movable relative to said second contact piece as said second contact piece moves relative to said first contact piece, between said first and second positions;

a second plurality of contact elements each having one end connected to one of said second and third contact pieces, a contact surface at the other end thereof that is in mechanical and electrical contact with the other of said second and third contact pieces when the contact pieces are in said first relative position, and a looped shaped region between said two ends through which current flows to generate an arc-extinguishing magnetic field, said points of contact of the other ends of said second plurality of contact elements being displaced relative to those of said first plurality of contact elements such that two-stage commutation occurs during said relative movement from said first to said second position; and means for quenching an arc disposed in an arc space adjacent the other end of at least one of said pluralities of contact elements.

2. The switch according to claim 1 wherein one of said first and second contact pieces comprises a metal tube; and further wherein said second plurality of contact elements comprise contact bars, said contact bars being included on said metal tube.

3. The switch according to claim 2 wherein said metal tube includes a plurality of slits extending substantially longitudinally from an end of said metal tube; and further wherein regions included between each of said slits comprise said contact bars.

4. The switch according to claim 1 wherein said spring element comprises a flat spring.

5. The switch according to claim 1 wherein said means for quenching an arc comprises at least one annular quenching sheet member.

6. The switch according to claim 1 wherein said means for quenching an arc comprises at least one quenching plate member.

7. The switch according to claim 6 wherein said quenching plate member includes a recess such that said quenching plate member has a stirrup-like configuration.

* * * * *